United States Patent [19]

Knudsen

[11] Patent Number: 4,526,321

[45] Date of Patent: Jul. 2, 1985

[54] APPARATUS FOR CLEANING SURFACES

[75] Inventor: Soren Knudsen, Søborg, Denmark

[73] Assignee: Gerni A/S, Randers, Denmark

[21] Appl. No.: 531,522

[22] Filed: Sep. 12, 1983

Related U.S. Application Data

[62] Division of Ser. No. 262,869, May 12, 1981.

[51] Int. Cl.[3] ..... B05B 3/14

[52] U.S. Cl. ..... 239/229; 239/255; 239/263

[58] Field of Search ..... 239/225, 229, 255, 251, 239/263, 102

[56] References Cited

U.S. PATENT DOCUMENTS 2,865,673 12/1958 Hathaway ..... 239/229
3,587,972 6/1971 Weeth ..... 239/229
3,633,826 1/1972 Baker ..... 239/229
3,897,605 8/1975 Dickinson ..... 239/229

*Primary Examiner*—Andres Kashnikow
*Attorney, Agent, or Firm*—Millen & White

[57] ABSTRACT

In a sluicing pipe opening into a nozzle tiltably arranged and swinging about an axis perpendicular to the longitudinal axis of the nozzle, oscillating movements of the nozzle are produced by moving means actuatable by cleaning liquid flowing to the nozzle. The moving means may be a spiral, resilient liquid inlet pipe, the nozzle being located at the free end of said pipe. However, the moving means may also be a rotor in a hydraulic motor, the outlet of which communicates with the nozzle or a spring loaded, pivoting means driven by the reaction force of the nozzle. Since the nozzle may oscillate by means of a few and light components, it is suitable for a manually operated, light spray gun.

15 Claims, 12 Drawing Figures

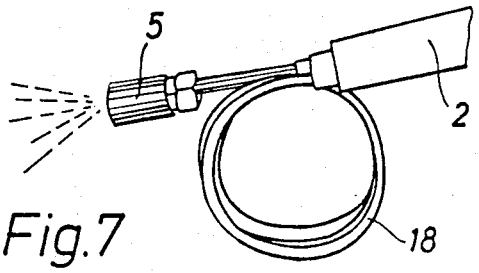
Fig.7
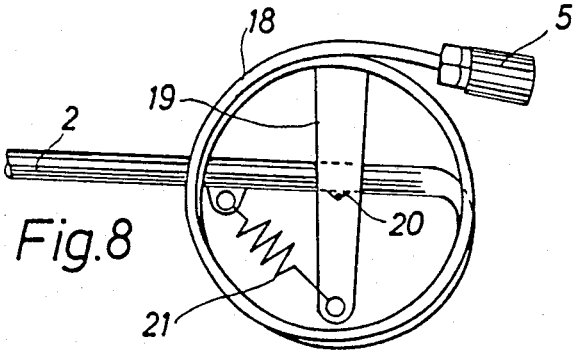
Fig.8
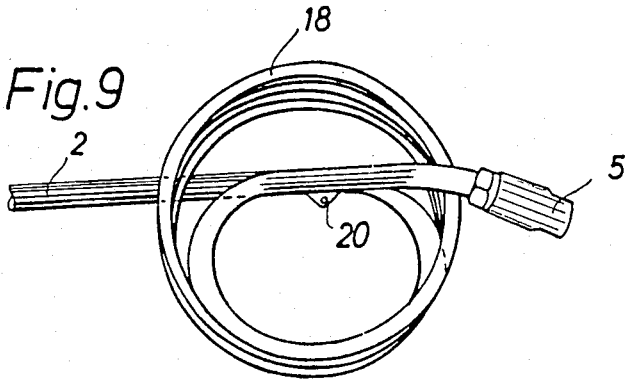
Fig.9
Fig.10
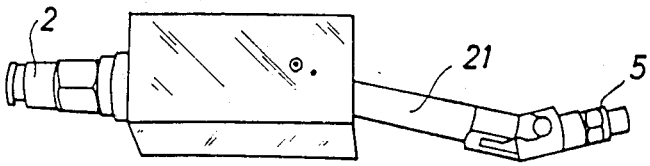

APPARATUS FOR CLEANING SURFACES

This is a division of application Ser. No. 262,869 filed May 12, 1981.

BACKGROUND OF THE INVENTION

The present invention relates to an apparatus for cleaning surfaces by means of a jet of cleaning liquid and comprising a sluicing pipe opening onto a nozzle tiltably arranged and adapted to perform oscillating movements about an axis substantially perpendicular to the longitudinal axis of the nozzle.

It is known that the cleaning effect of a jet is increased and that a considerable energy savings is obtained when the cleaning liquid in the jet is set into oscillation in and/or transverse to the jet direction. Thus tilting nozzles are known which are located at the end of a pipe, with the pipe being connected to an electromotor through a crank mechanism in a manner such that the movement of the rotor is converted into an oscillating movement by the pipe comprising the nozzle. Furthermore, it is also known for instance, in connection with washing machines, to drive a number of nozzles into an oscillating movement by means of a reversible motor. These known apparatuses comprising tilting nozzles are, however, either stationary or intended to move in a "feed movement" in guides along the surface to be cleaned or directly supported thereof. No manually operable spray guns comprising a tilting nozzle are, however, known.

For other purposes it is known to use a so-called fluidistor nozzle, in which the flow conditions are such that an oscillating jet is emitted without employing mechanically movable parts. At the velocities and pressures employed in high pressure cleaners, the liquid from such a nozzle is, however, so finely atomized that the cleaning effect is considerably lower than in a jet not oscillating. This is due to the fact that an efficient cleaning effect depends on the cleaning liquid being emitted in the form of relatively large drops.

SUMMARY OF THE INVENTION

The object of the present invention is to provide an apparatus comprising a tiltably mounted nozzle of so few and light components that it may be used as an easily operable spray gun.

The apparatus according to the invention is characterized in that it comprises moving means mounted at the discharge end of the sluicing pipe and adapted to be actuated by the cleaning liquid flowing to the nozzle. The moving means is connected to the nozzle in such a manner that it drives the nozzle into the oscillating movement.

By utilizing the velocity of flow and the pressure of the cleaning liquid flowing to the nozzle, it is possible to avoid the use of a heavy electromotor and of inconvenient, separate conduits for the supply of energy in the form of electricity or possibly compressed air. This means that the apparatus comprising the tilting nozzle may be constructed as a usual spray gun of a low weight and without other connecting conduits than the hose for the cleaning liquid.

The moving means may according to the invention be a rotor in a hydraulic motor situated within a housing and connected through a driving connection such as a crank or eccentric connection to the nozzle tiltably arranged in the housing, the interior of said nozzle being in liquid connection with the outlet of the motor. The rotor or the turbine wheel may be made of a light material and without observing narrow limits, and together with the tilting nozzle and the movement transferring means, which may be formed in many ways, it may be included in a relatively small housing.

According to the invention, the moving means may also be a piston in a hydraulic motor, said piston driving the tiltably arranged nozzle by means of a rod connection, whereby the mechanical power transmission may be very simply performed, but whereby the motor, however, is rather complicated.

In mechanical respect relatively simple constructions may be obtained by the invention, the moving means involved being adapted to be driven by the reaction force of the nozzle.

As previously stated the cleaning effect is improved both by oscillations transverse to the axis of the nozzle and by longitudinal, i.e. pulsating, oscillations, and according to the invention it is therefore preferred to connect the spray gun with a feeder for a pulsating flow of the cleaning liquid, preferably a feeder from a piston pump, but optionally also a feeder in which pulsations are produced in an arbitrarily known manner. An embodiment of the apparatus according to the invention which is intended for receiving such a pulsating flow is characterized by the nozzle being pivotably located about an axis of rotation at a distance to and perpendicular to the nozzle axis and furthermore, retained in the position by means of a spring tension permitting oscillating movements to be performed by said nozzle about the axis of rotation at passage of the pulsating jet of liquid. Such an apparatus may be manufactured so as to be of a still lower weight than the above embodiments and of a far more simple construction, since the nozzle may be shaped as the discharge opening of a channel formed in a pivotable block, said channel being supplied with the cleaning liquid at the axis of rotation.

The tilting nozzle may be pivotally mounted about an axle located in the housing or on a ball-and-socket joint, but according to a simple embodiment the nozzle may also be located at one end of a branch of hose of resilient deformable material such as for instance nylon, teflon or reinforced plastics. The tilting of the nozzle may then be produced either by bending the branch of hose (radial deformation) or by wringing said branch of hose (tangential deformation).

A very simple, constructive embodiment is according to the invention obtained by the nozzle being located at the free end of a spiral, resilient inlet pipe for the cleaning liquid. The spiral pipe is made oscillate by means of the pressure pulsations in the liquid since partly the pulsating reaction force and partly the bourdon effect deform the spiral. By appropriately adapting the mass of the nozzle to the rigidity of the spiral in such a manner that the resonant frequency of the system is identical with the pumping frequency, it is possible to make the spiral oscillate particularly heavily. In order to reduce the risk of fatigue fractures deriving from a disadvantageous load pattern on the unsupported spiral, the nozzle may according to the invention be secured to one end of an arm pivotally located at the middle of the spiral, the opposite end of said arm being secured to a tension spring for counter-balancing the reaction force of the nozzle. In this embodiment the reaction force of the nozzle is completely received by the bearing in the middle of the spiral.

An embodiment of the apparatus according to the invention which is simple in mechanical respect, is characterized by the nozzle being pivotally located as the outer link of a double-link pendant, the inner link of said pendant forming a tubular connection between the sluicing pipe and the nozzle. The pendant is driven by the reaction force of the pivotally located nozzle, but the simple mechanical construction is made at the expense of rather heavy vibrations in the handle of the spray gun, and the nozzle oscillates at a rather low frequency.

BRIEF DESCRIPTION OF THE DRAWINGS

The invention will be described below with reference to the accompanying drawing, in which:

FIGS. 7 to 9 illustrate embodiments of tilting nozzles connected to a coil and driven by a cleaning liquid under pulsating pressure, and FIG. 10 illustrates an embodiment of a tilting nozzle forming a link of a double-link pendant and driven by the reaction force of the nozzle.

DETAILED DISCUSSION OF THE INVENTION

Figure 1:
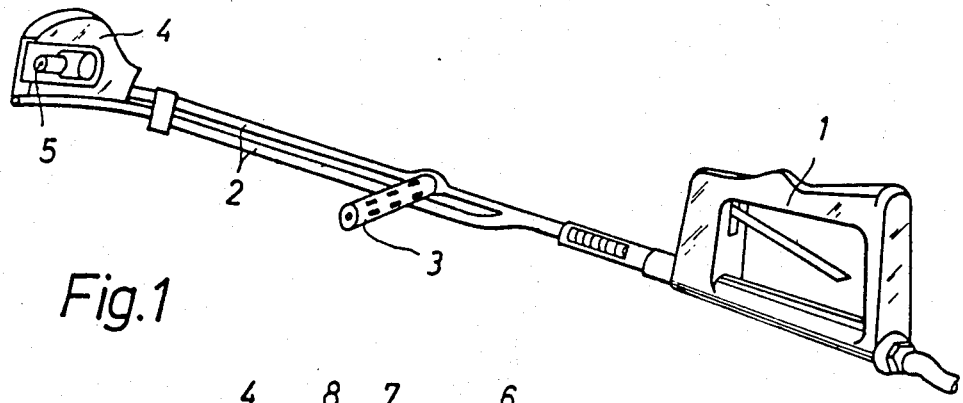
FIG. 1 illustrates an embodiment of the apparatus according to the invention forming as a spray gun.

The apparatus according to the invention may be formed as a usual spray gun, e.g. as illustrated in FIG. 1, comprising a handle 1 and a double sluicing pipe 2, one branch of which carries a pivotable adjusting lever 3. At the end of the sluicing pipe 2 is located a housing 4 for a tiltably located nozzle, said nozzle being set into oscillating movements by means of a hydraulic motor situated in the housing. The nozzle is adopted to oscillate 5° to 50° to both sides relative to the middle axis, and at a frequency ranging from 1 to 500 Hz.

Figure 2:
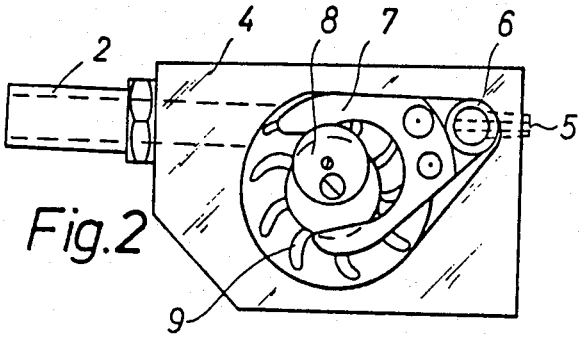
FIGS. 2 and 3 illustrate two embodiments of the apparatus, whereby the tilting nozzle by means of an eccentric mechanism and a crank mechanism, respectively, is driven by a motor influenced by the cleaning liquid, FIGS. 3A and 3B respectively illustrate the crank connection and the pivot.
Figure 3A:
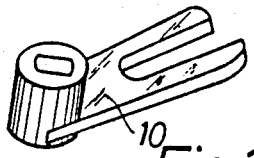
Figure 3:
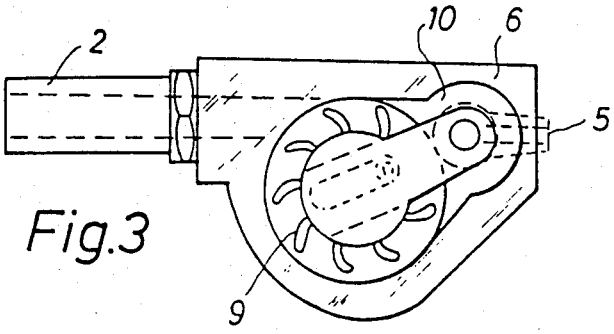
Figure 3B:
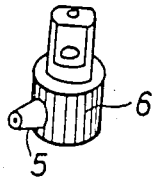

FIG. 2 illustrates an example of how a tilting nozzle 5 shaped in a pivot 6 by means of a strap 7 and an eccentric 8 is set into oscillation from a paddle wheel 9 passed by the cleaning liquid before said cleaning liquid flows to the nozzle. FIG. 3 illustrates a similar construction whereby the paddle wheel 9 carries a crank, which by means of a crank connection 10 sets the pivot 6 and the nozzle 5 shaped therein into oscillations. The shape of the crank connection 10 and the pivot 6 appears from FIGS. 3A and 3B. The nozzle 5 may be located in many other ways than illustrated, and for instance, in such a manner that it is located at the end of a branch of hose of resilient deformable material. Furthermore, it may be drivenly connected to the hydraulic motor in such a manner that the hose is either bent from side to side or wringed about its longitudinal axis, the nozzle in the latter case comprising an L-shaped flow channel, whereby the jet emitted forms an angle with the longitudinal axis of the hose. The hose may, for instance, be made of preferably reinforced plastics such as for instance nylon or Teflon. The hydraulic motor may also be shaped in many other ways than shown, for instance, so as to utilize either the velocity of flow or the pressure of the liquid. Rotational motors are, however, preferably employed, which may operate without valves when they for instance are shaped as an impeller or a wing motor. Finally, the hydraulic motor may be a piston motor, the piston rod of which communicates with the tiltably located nozzle, such an embodiment, however, requiring a more complicated motor construction.

Figure 4:
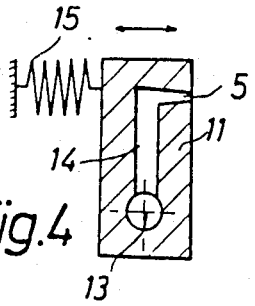
FIGS. 4 to 6 illustrate various embodiments of tilting nozzles driven by a cleaning liquid under pulsation pressure.
Figure 5:
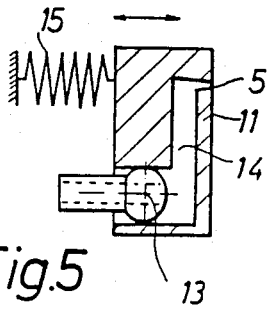
Figure 6:
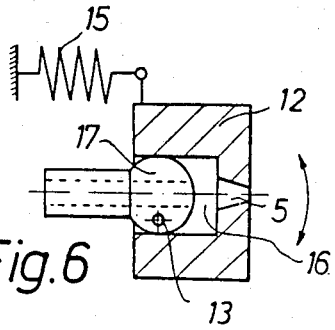

Particularly simple constructions of the tilting nozzles may be obtained when the cleaning liquid is supplied to the spray gun with pulsating pressures. FIGS. 4 to 6 are diagrammatical view of some embodiments whereby the nozzle is shaped in a block 11 and 12, respectively, said block being pivotally located about an axis 13. In the embodiments of FIGS. 4 and 5 the cleaning liquid is supplied at the axis of rotation 13 and flows through a channel 14 to the nozzle 5. The pulsating reaction force of the nozzle is received by a spring 15, the line of application of said reaction force being displaced relative to the axis of rotation. By adapting the rigidity of the spring to the mass of the movable nozzle unit in such a manner that the resonant frequency of the system is identical with the pumping frequency, it is possible to set the system into oscillation at so low a pulsation level as ±20% of the mean value of the pressure.

FIG. 6 illustrates a modification whereby the pressure pulsations in the cleaning liquid influence a pressure chamber 16 of varying volume. The pressure chamber expands at increasing pressure and is compressed by the spring 15 at decreasing pressure. In this modification the block 12 is pivotably and displaceably located on a ball-and-socket head 17.

FIGS. 7 to 9 illustrate tilting nozzles also set into oscillations by means of pulsating pressures in the cleaning liquid supplied. From the sluicing pipe 2 the cleaning liquid flows through a spiral, resilient inlet pipe 18 to the nozzle 5. This spiral is periodically deformed by means of the pulsating reaction force of the nozzle and the bourdon effect. By adapting the mass of the nozzle to the rigidity of the spiral in such a manner that the resonant frequency of the system is identical with the pumping frequency, the spiral may be set into particularly heavy oscillations. FIG. 7 illustrates an unsupported spiral. In this embodiment the reaction force of the nozzle influences the individual spiral windings with a bending moment being zero at the nozzle and increasing uniformly to its maximum value diametrically opposite the nozzle. As the deformation of the pipe is proportional to the load, maximum deformation of the pipe is only obtained on one spot, which may involve fatigue fractures. By involving a maximum deformation all along the spiral it is on the contrary possible to double the angular turning without increasing the risk of fatigue fractures.

In order to obtain an improved load pattern the pipe spiral 18 may be supported as illustrated in FIGS. 8 and 9. By locating the spiral by means of an arm 19, cf. FIG. 8, which is pivotable about an axis 20, it is possible to convert the reaction force of the nozzle 5 into a uniform bending moment all along the spiral, which provides an optimum deformation thereof. A spring 21 located between the free end of the arm 19 and at its opposite end connected to the inlet pipe to the spiral 2 provides a pre-stress of the spiral in such a manner that it is possible to counter-balance completely or partially the mean value of the pulsating reaction force.

In the embodiment illustrated in FIG. 9 the outlet pipe of the spiral is supported in such a manner that the bearing at the axis 20 in the middle of the spiral receives completely the reaction force of the nozzle. In this manner it is obtained that the deformation of the spiral is exclusively produced by the bourdon effect, whereby a uniform deformation of the entire spiral is ensured. Furthermore, this embodiment comprises the advantage that the reaction force of the nozzle does not pre-stress the spiral, whereby it may operate at varying pressures.

FIG. 10 illustrates an embodiment of a tilting nozzle which is rather simple in mechanical respect. In this embodiment the tilting nozzle 5 forms the outer link of a double-link pendant, the second link 21 of which forms a connecting pipe between the sluicing pipe 2 and the nozzle 5. The double-link pendant is driven by the reaction force of the pivotable nozzle 5, and it is thereby possible to make the jet oscillate from side to side. The relatively great mass of the movable parts renders it possible to make the nozzle oscillate at a rather low frequency. However, this simple mechanical embodiment has the drawback that the pendant oscillations produce rather heavy vibrations in the spray gun.

It is to be understood that within the idea of the invention numerous modifications and changes may be made in the above components of the apparatus.

I claim:

1. In an apparatus for cleaning surfaces by means of a jet of cleaning liquid and comprising a sluicing pipe opening into a nozzle tiltably arranged on said pipe and adapted to oscillate about an axis substantially perpendicular to the longitudinal axis of the nozzle, the improvement wherein said apparatus is portable, low weight and easily carried by an operator when in use, said nozzle is adapted to generate a reaction force in response to a jet of cleaning liquid flowing therefrom, and said apparatus comprising moving means at the discharge end of the sluicing pipe and arranged for being activated by the cleaning liquid flowing to the nozzle and connected to the nozzle in such manner that it drives said nozzle into oscillating movement as a result of being driven by the reaction force of the nozzle when cleaning fluid is flowing therefrom, said sluicing pipe comprising as part of said moving means a feeder connected to the nozzle and adapted to provide a pulsating flow of cleaning liquid, and with said nozzle arranged pivotally about an axis of rotation spaced from and perpendicular to the axis of the nozzle, and retained in position by spring means exerting a spring tension for permitting oscillating movements of said nozzle about said axis of rotation upon passage of a pulsating jet of liquid from said nozzle.

2. An apparatus as in claim 1 wherein said nozzle opens on a block having a channel connected to the nozzle for feeding fluid thereto, and with the feeder connected to said channel in said block for feeding fluid at a location on said block coincident with an axis about which said block is adapted to pivot for oscillating said nozzle as a result of a pulsating liquid flow thereto (FIGS. 4 and 5).

3. An apparatus as in claim 1 wherein said nozzle opens on a block having a chamber, with said feeder having a ball and socket head upon which is slidably mounted said block at said chamber thereby defining said chamber as a chamber of varible volume whereby, as a pulsating liquid flow is fed to said chamber, the chamber expands and contracts causing pivoting about said ball and socket head as a result of the pulsating nature of the flow in combination with the spring tension of the spring means (FIG. 6).

4. An apparatus as in claim 2 wherein said feeder is connected to said block to feed the liquid in a direction substantially perpendicular to the direction of flow from the nozzle (FIG. 4).

5. An apparatus as in claim 2 wherein said feeder is connected to said block to feed the liquid in a direction substantially parallel to the direction of flow from the nozzle (FIG. 5).

6. An apparatus as in claim 1 wherein said nozzle is located at one end of a branch of hose of resilient deformable material.

7. An apparatus as in claim 6 wherein said resilient deformable material is one of nylon, teflon and reinforced plastics.

8. An apparatus as in claim 1 wherein said nozzle is located at the free end of a spiral, resilient pipe adapted for having the cleaning liquid flow therethrough to the nozzle.

9. An apparatus as in claim 8 wherein said nozzle is secured to one end of an arm pivotally connected to the middle of said spiral, and with the other end of said arm secured to a spring member arranged for counterbalancing the reaction force generated by said nozzle when a jet of liquid flows therefrom.

10. An apparatus as in claim 9 wherein said spring member is a tension spring.

11. An apparatus as in claim 8 further comprising a bearing arranged in the middle of the spiral for receiving the reaction force generated by said nozzle when a jet of cleaning liquid flows therefrom.

12. An apparatus as in claim 1 wherein said spring means comprises a spiral resilient pipe with said nozzle located at the free end of said spiral, resilient pipe, and with said pipe adapted for having the cleaning liquid flow therethrough.

13. An apparatus as in claim 12 wherein said nozzle is secured to one end of an arm pivotally connected to the middle of said spiral, and with the other end of said arm secured to a spring member arranged for counterbalancing the reaction force generated by said nozzle when a jet of liquid flows therefrom.

14. An apparatus as in claim 13 wherein said spring member is a tension spring.

15. An apparatus as in claim 12 further comprising a bearing arranged in the middle of the spiral for receiving the reaction force generated by said nozzle when a jet of cleaning liquid flows therefrom.

* * * * *